US005299958A

United States Patent [19]

Ohsumi

[11] Patent Number: 5,299,958

[45] Date of Patent: Apr. 5, 1994

[54] CONNECTOR

[75] Inventor: Hideki Ohsumi, Shizuoka, Japan

[73] Assignee: Yazaki Corporation, Tokyo, Japan

[21] Appl. No.: 875,423

[22] Filed: Apr. 29, 1992

[30] Foreign Application Priority Data

Apr. 30, 1991 [JP] Japan ..... 3-30134[U]

[51] Int. Cl.[5] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 4,867,712 | 9/1989 | Kato et al. | 439/752 |
| 4,946,398 | 8/1990 | Takenouchi et al. | 439/752 |
| 4,946,399 | 8/1990 | Kawashima | 439/752 |
| 5,066,252 | 11/1991 | Kato | 439/752 |

FOREIGN PATENT DOCUMENTS

| | | |
|---|---|---|
| 3828872 | 3/1989 | Fed. Rep. of Germany . |
| 2218272 | 1/1989 | United Kingdom . |
| 2211033 | 6/1989 | United Kingdom . |
| 2248350 | 4/1992 | United Kingdom . |

*Primary Examiner*—Gary F. Paumen

*Attorney, Agent, or Firm*—Sughrue, Mion, Zinn, Macpeak & Seas

[57] ABSTRACT

In a connector, a terminal lock member has openings in correspondence to terminal accommodating chambers formed in a connector housing. Of the vertical plates forming the terminal lock member, two are suitably selected. Each of the vertical plates thus selected has a first locking protrusion on one end face thereof, and a flexible arm formed by cutting a slit therein in such a manner that the flexible arm has a second locking protrusion on the other end fact. On the other hand, the connector housing has first and second engaging portions and in correspondence to the first and second locking protrusions. When the terminal lock member is inserted into the housing through the cavity to a temporary locking position where the openings align with the terminal accommodating chambers, the first locking protrusions are engaged with the first engaging portions, so that the terminal lock member is temporarily locked there. When the terminal lock member is further inserted into the housing from the temporary locking position to a real locking position where the terminal locking portions are engaged with terminals to prevent the latter from coming off backwardly, the second locking protrusions are engaged with the second engaging portions, whereby the terminal lock member is positively locked there.

6 Claims, 7 Drawing Sheets

CONNECTOR

BACKGROUND OF THE INVENTION

This invention relates to an improvement of a connector which comprises a terminal lock member which is inserted in the middle portion of a connector housing in addition to flexible lock arms provided in terminal accommodating chambers formed in the connector housing.

FIG. 10 shows a conventional connector with a terminal double-lock mechanism. In order to prevent terminals from inadvertently being displaced rearwardly, a primary locking flexible lock arm (not shown) is, in general, provided in each of terminal accommodating chambers b formed in a connector housing a. In order to increase the number of poles of the connector, or in order to miniaturize the connector, the flexible lock arm is limited in dimension, and accordingly its terminal holding force is not so large. In order to overcome this difficulty, a terminal lock member c is provided to double-lock the terminals.

That is, a cavity d is formed in one outer wall a: of the connector housing a in such a manner that it is extended across the terminal accommodating chambers b, and the terminal lock member c is inserted into the housing through the cavity d thus formed so that terminal locking portions $c_2$ formed in openings $c_1$ of the terminal lock member c are engaged with the terminals, thereby to double-lock the terminals together with the flexible lock arms.

In the conventional connector with the double lock mechanism as shown in FIG. 10, the terminal lock member c has two flexible locking arms $d_1$ and $d_2$ on the outer surface of each of the right and left side walls $c_3$ and $c_3$, to lock the terminal lock member c to the connector housing a. The flexible locking arms $d_1$ and $d_2$ are both externally exposed, and are therefore liable to be deformed or damaged by external force. Furthermore, the presence of the locking arms results in an increase in width of the terminal lock member c, thus making the connector itself bulky as much.

In view of the foregoing, an object of this invention is to provide a connector in which locking members such as the above-described flexible locking arms of the terminal lock member which is engaged with the connector housing are not readily deformed by external force, and the terminal lock member is prevented from increasing in width, which contributes to miniaturization of the connector.

SUMMARY OF THE INVENTION

The foregoing object of the invention has been achieved by the provision of a connector which, according to the invention, comprises:

a housing having a plurality of terminal accommodating chambers arranged therein, and a cavity formed in one outer wall thereof in such a manner that the cavity is extended vertically across partition walls of the terminal accommodating chambers; and a terminal lock member having openings in correspondence to the plurality of terminal accommodating chambers, and terminal locking portions in the openings which are engaged with terminals, the terminal lock member being inserted into the housing through the cavity and moved from a temporary locking position to a real locking position, the terminal lock member being a grid shaped frame, wherein the terminal lock member includes:

a vertical plate which has a first locking protrusion on the side of one end face thereof; and a flexible arm formed by cutting a slit in the vertical plate in such a manner that the flexible arm has a second locking protrusion on the other end face, and the housing further includes:

a first engaging portion which, when the terminal lock member is inserted into the housing to the temporary locking position where the openings thereof are substantially aligned with the terminal accommodating chambers, is engaged with the first locking protrusion so that the housing is temporarily locked there; and a second engaging portion which, when the terminal lock member is moved from the temporary locking position to the real locking position where the terminal locking portions engage with the terminals to prevent the terminals from coming off backwardly, is engaged with the second locking protrusion, to positively lock the terminal lock member.

In the connector of the invention, the first locking protrusion is formed on one of the front and rear end faces of a vertical plate forming the terminal lock member, and the flexible arm with the second locking protrusion is formed along the other end face by cutting the slit in the vertical plate. Hence, the connector can be miniaturized with the terminal lock member prevented from increasing in width. Each of the first and second locking protrusions is so small in the amount of projection from the end face, and is therefore scarcely affected by external force, thus locking the terminal lock member to the connector housing with high stability.

Another object of the invention has been achieved by the provision of a connector which, according to the invention, comprises:

a housing having a plurality of terminal accommodating chambers arranged therein, and a cavity formed in one outer wall thereof in such a manner that the cavity is extended vertically across partition walls of the terminal accommodating chambers; and a terminal lock member having partition walls of the plurality of terminal accommodating chambers in correspondence to a cover plate engaged with the cavity, side plates corresponding to outermost side walls of the terminal accommodating chambers and terminal locking portions, which are engaged with the terminal, provided at the side portion of the side plates, the terminal lock member being inserted into the housing through the cavity and moved from a temporary locking position to a real locking position, the terminal lock member being a comb shaped frame, wherein the terminal lock member includes:

an outermost vertical plate which has a first locking protrusion on the side of one end face thereof; and a flexible arm formed by cutting a slit in the vertical plate in such a manner that the flexible arm has a second locking protrusion on the other end face, and the housing further includes:

a first engaging portion which, when the terminal lock member is inserted into the housing to the temporary locking position where terminals are inserted into the terminal accommodating chambers, respectively, is engaged with the first locking protrusion so that the housing is temporarily locked there; and a second engaging portion which, when the terminal lock member is moved from the temporary locking position to the real locking position where the terminal locking portions engage with the terminals to prevent the terminals from coming off backwardly, is engaged with the second locking protrusion, to positively lock the terminal lock member.

In the connector of the invention, the first locking protrusion is formed on one of the front and rear end faces of a vertical plate forming the terminal lock member, and the flexible arm with the second locking protrusion is formed along the other end face by cutting the slit in the vertical plate. Hence, the connector can be miniaturized with the terminal lock member prevented from increasing in width. Each of the first and second locking protrusions is so small in the amount of projection from the end face, and is therefore scarcely affected by external force, thus locking the terminal lock member to the connector housing with high stability. On the other hand, terminal lock member which is comb shaped The grid and comb terminal lock members are the same expecting the shape, the comb shaped terminal lock members is different from grid shaped terminal lock members in the engaging structure relating to the terminal.

BRIEF DESCRIPTION OF THE DRAWINGS

FIG. 3 (*b*) is a sectional view showing the terminal lock member B which is positively locked;

DETAILED DESCRIPTION OF THE PREFERRED EMBODIMENTS

The preferred embodiments of the present invention will now be described with reference to accompanying drawings.

Figure 1:
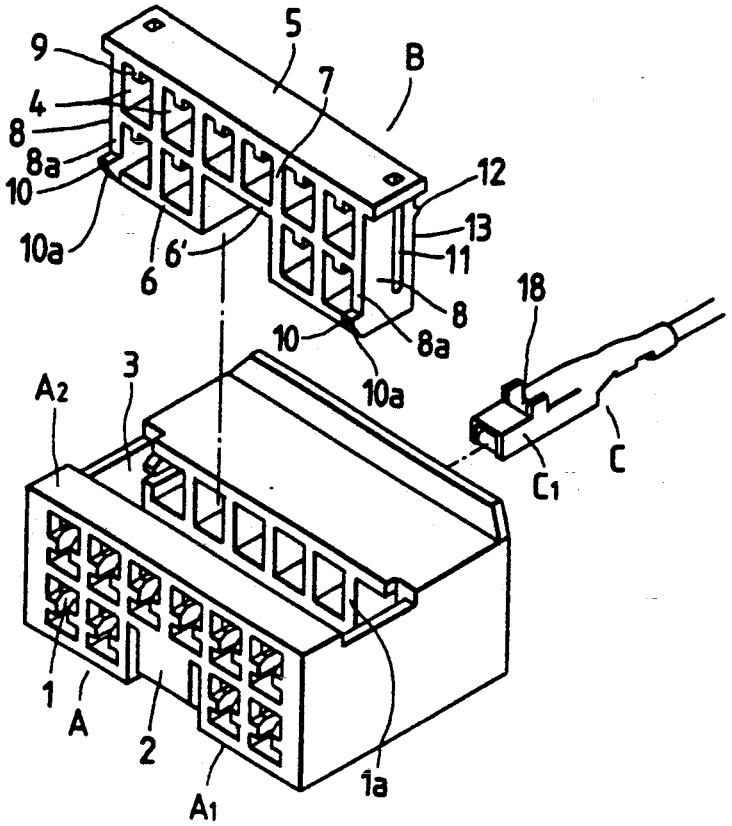
FIG. 1 is an exploded perspective view of an example of a connector according to this invention.
Figure 2:
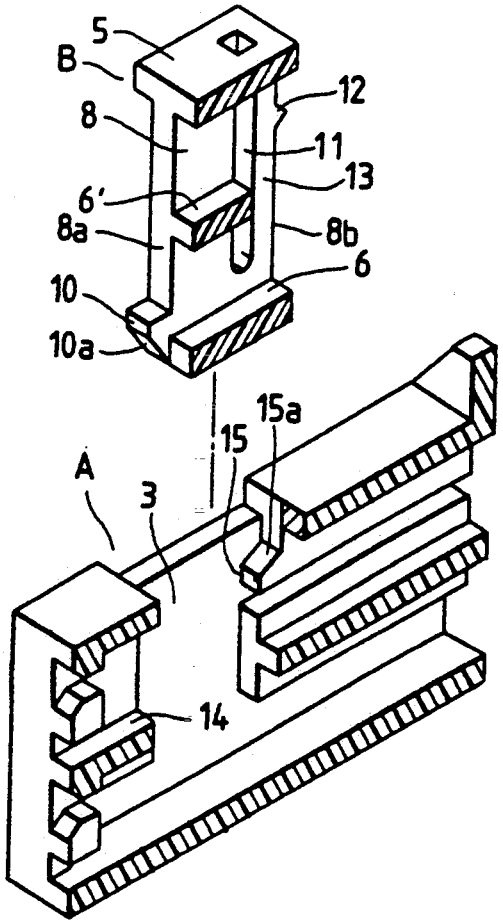
FIG. 2 is an enlarged sectional view showing essential parts of a connector housing A and a terminal lock member B shown in FIG. 1.

In FIGS. 1 and 2, reference character A designates a male connector housing of insulating material, synthetic resin; B, a terminal lock member; and C, a female terminal. In the connector housing A, a plurality of terminal accommodating chambers 1 are arranged in two layers in such a manner that they are positioned side by side in each layer. A locking arm 2 is formed in the upper outer wall A of the connector housing A, which is to be engaged with a female connector housing (not shown), and a cavity 3 is formed in the middle of the lower outer wall $A_2$ in such a manner that it extends vertically across the partition walls 1*a* of the terminal accommodating chambers. The terminal lock member B is detachably engaged with the connector housing through the cavity 3 this formed.

The terminal lock member B is a grid-shaped frame having openings 4 which are substantially the same as the above-described plurality of terminal accommodating chambers 1. The terminal lock member B is made up of: a cover plate 5 engageable the lower outer wall $A_2$ of the connector housing; bottom plates 6 and a middle plate 6, which are in parallel with the cover plate 5; vertical plates 7 which are engaged with the partition walls 1*a* of the terminal accommodating chambers 1; and right and left side plates 8 and 8 which are the outermost vertical plates. In each of the openings 4, a terminal locking portion 9 is protruded so that it is engaged with a locking hole 18 (cf. FIG. 4) of the female terminal C. A first locking protrusion 10 is formed on the front end face 8*a* of each of the side plates 8 and 8 at the lower end. Furthermore, in each of the right and left side plates 8, a slit 11 is cut to form a flexible arm 13, as a beam portion, with a second locking protrusion 12 in such a manner that the flexible arm 13 is extended along the rear end face 8*b* of the side plate 8, and its both ends are held by the cover plate 5 and the bottom plate 6, respectively. The lower surface of the first locking protrusion 10 is formed into a sloped surface 10*a*, and the second locking protrusion 10 is tapered outwardly, or it is V-shaped in section, thus having upper and lower sloped surfaces. The first and second locking protrusions 10 and 12 are formed on the side plates 8; however, they may be formed on the intermediate vertical plates 7 as the case may be.

In correspondence to the first and second locking protrusions 10 and 12 of the terminal lock member B, first and second engaging portions 14 and 15 are formed in the connector housing A as shown in FIGS. 2 and 3. The first engaging portion 14 functions as follows: When the openings 4 of the terminal lock member B, inserted into the connector housing A through the cavity 3, substantially align with the terminal accommodating chambers 1, the first engaging portion 14 is engaged with the first locking protrusion 10 so that the terminal lock-member is temporarily locked there (a temporary locking position). For this purpose, the upper surface of the engaging portion 14 is formed into a sloped surface 14*a*. The second engaging portion 15 serves as follows: When the terminal lock member B is further inserted; that is, when the terminal locking portion 9 of the terminal lock member is engaged with the locking hole 18 of the female terminal C, the second engaging portion 15 is engaged with the second locking protrusion 12 so that the terminal lock member is positively locked there (a real locking position). For this purpose, similarly as in the case of the first engaging portion 14, the second engaging potion 15 has a sloped surface 15*a*.

Figure 3A:
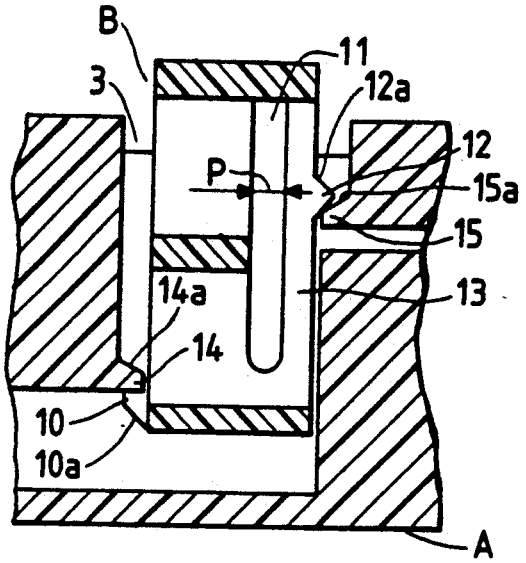
FIG. 3 (*a*) is a sectional view showing the terminal lock member B which is temporarily locked.

When, in the connector thus constructed, the terminal lock member B is inserted in the cavity 3 of the connector housing A and then pushed lightly, as shown in FIG. 3(A) the first locking protrusion 10 is moved over the first engaging portion 14 with the aid of their sloped surfaces 10*a* and 14*a*, and is positioned below the latter 14. At the same time, the second locking protrusion 12 is set on the second engaging portion. 15. Thus, the terminal lock member is temporarily locked. At this temporary locking position, the openings 4 of the terminal lock member B are substantially in alignment with the terminal accommodating chambers 1, so that the female terminals C can be inserted into the connector housing from behind.

Figure 3B:
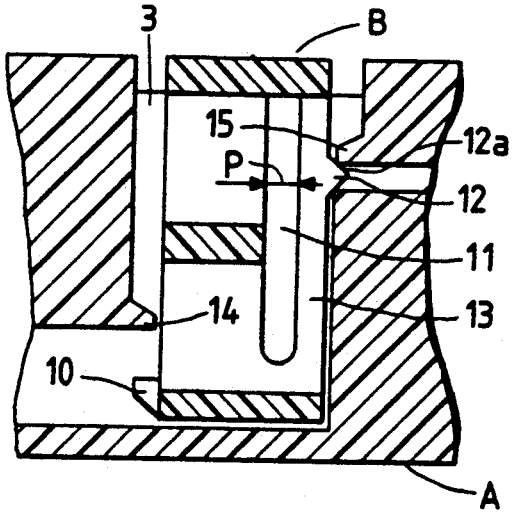
Figure 4:
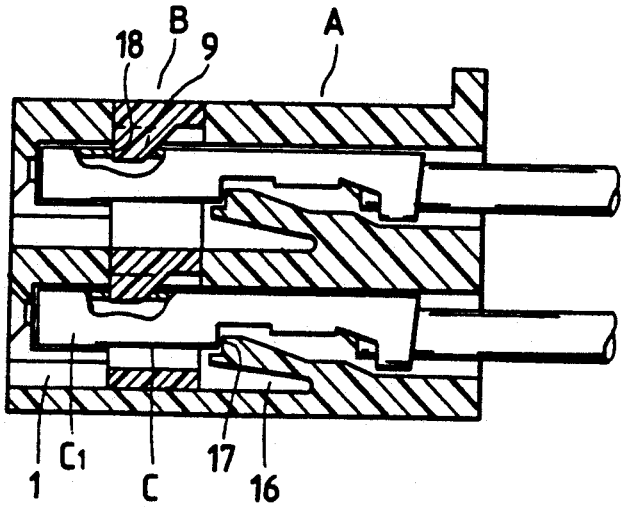
FIG. 4 is a vertical sectional view showing the connector of which invention in which the terminals have been double-locked.
Figure 5:
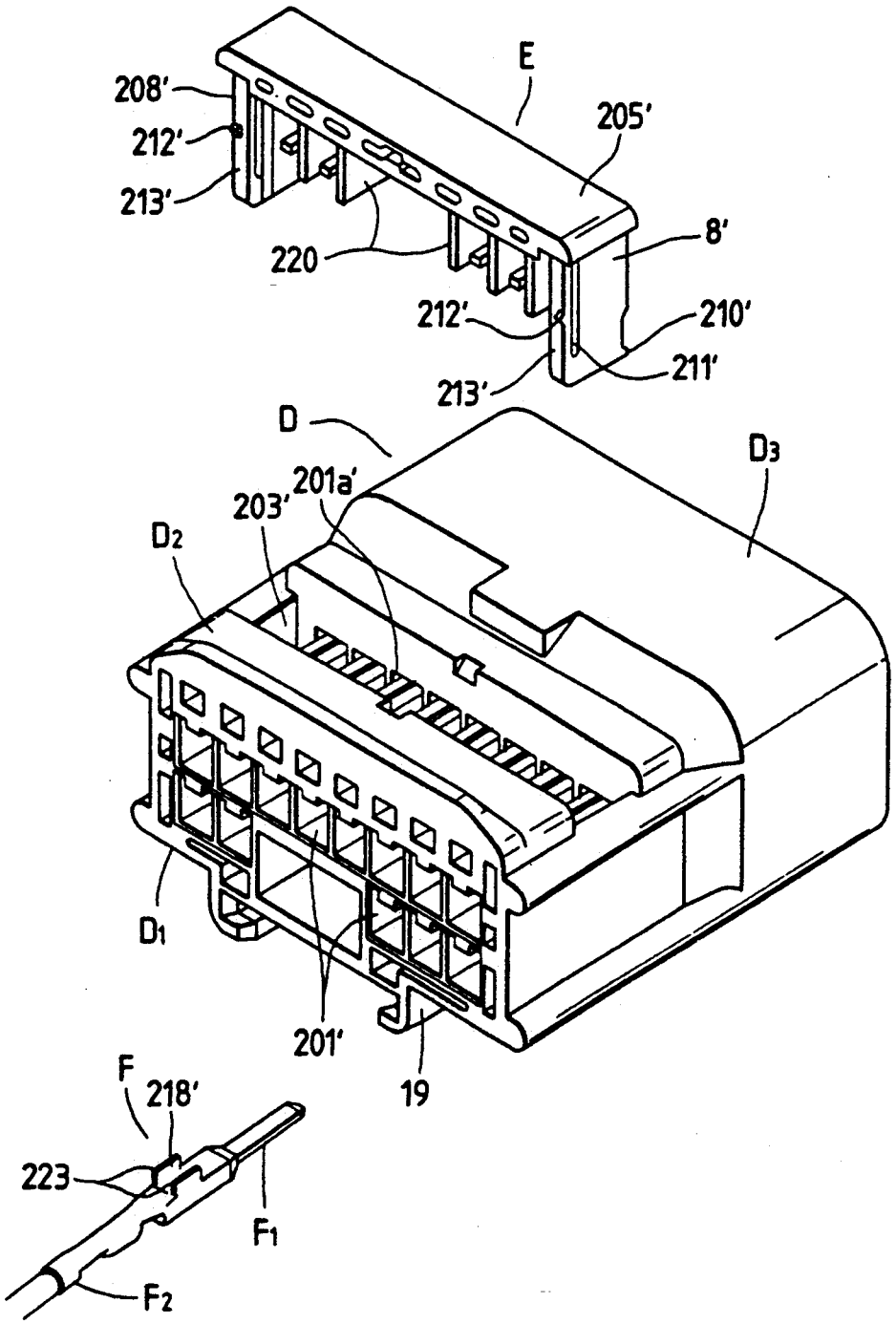
FIG. 5 is an exploded perspective view of second example of a connector according to the present invention.

When, under this condition, the terminal lock member B is further depressed, then as shown in of FIG. 3(B) the flexible arm 13 is elastically deflected as indicated by the arrow P because of the presence of the slit P. As a result, as shown in of FIG. 3(B), the second locking protrusion 12 is moved over the second engaging portion 15 with the aid of the sloped surfaces 12*a* and 15*a*, and is positioned below the second engaging portion 15. Thus, the terminal lock member B has been positively locked. When the terminal lock member is set at the real lock position, the female terminals C are double-locked. That is, when the female terminals C are inserted into the terminal accommodating chambers 1 with the terminal lock member set at the temporary lock position as shown in FIG. 3(A), then in the terminal accommodating chambers 1, flexible lock arms 16 formed therein are engaged with the shoulders 17 of the electrical contacts $C_1$ of the female terminals C to primarily lock the latter C as shown in FIG. 4(*a*). When, under this condition, the terminal lock member B is moved to the real locking position, in the openings 4 the terminal locking portions 9 are engaged with the locking holes 18 of the electrical contacts $C_1$, so that the terminals are double-locked.

While the first embodiment of the present invention has been described with reference to the case where the terminal lock member B is coupled to the male connector housing A with the female terminals C, it should be noted that the technical concept of the invention can be equally applied to a female connector with male terminals. In addition, the first locking protrusions 10 may be formed flexible similarly as in the case of the second locking protrusions 12. The female terminal C locking means may be so modified that, in the terminal accommodating chambers, the flexible locking arms 16 are engaged with the locking holes 18 of the electrical contacts $C_1$, while the terminal locking portions 9 of the terminal lock member B are engaged with the shoulders 17 of the electrical contacts. In use of the terminal lock board B, the primary locking means, namely, the flexible locking arms 16 may be eliminated from the terminal accommodating chambers 1.

A second embodiment of the present invention will be described in more detail. In FIGS. 5 to 9, reference character D designates a female connector housing of insulating material, synthetic resin; E, a terminal lock member; and F, a male terminal. In the connector housing D, a plurality of terminal accommodating chambers 201 are arranged in two layers. A insertion member 219 engaged with a bracket (not shown) is formed in an upper outer wall $D_1$. A cavity 203 is formed in a middle of the lower outer wall $D_2$ in such a manner that it extends vertically across partition walls 201*a* of the terminal accommodating chambers. The terminal receiving portion $D_3$ receiving a male connector housing is formed on a front portion of the female connector housing D.

Figure 6:
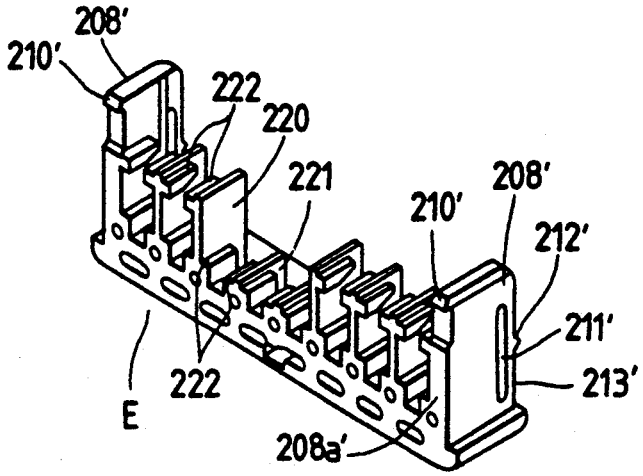
FIG. 6 is a perspective view of a terminal lock member shown in FIG. 5 at front side.

In FIG. 6, the terminal lock member E is difference in shape from that of first embodiment of the present invention. The terminal lock member is a comb shaped frame. The terminal lock member E is made up of: a cover plate 205 engaged with the cavity 203 of lower outer wall $D_2$; side walls 220, 221 corresponding to the partition walls 201*a*; and right and left side plates 208, provided at the outermost of the cover plates 205, used for side walls of the female connector housing D in common.

The side walls 220 correspond to the terminal accommodating chambers 201 in two layers and the length of the said walls 220 are longer than that of side wall 221 used in standard. The length of the side plates 208 are longer than that of side walls 220 provide at the middle portion of the cover plate 205.

A terminal lock portion 222 which is engaged with a lock projection 223 of a male terminal F described hereinafter is protruded from an inner side of the side plates 208, and both side of side walls 220 and 221. A first lock protrusion 210 is formed on the front end face 208*a* of each of the side plates 208 and 208 at the lower end. Furthermore, in each of the right and left side plates 208, a slit 11 is cut to form a flexible arm 213, as a beam portion, with a second lock protrusion 212 in such a manner that the flexible arm 213 is extended along the rear end face 208*b* of the side plate 8, and its end is held by the cover plate 205.

Figure 7:
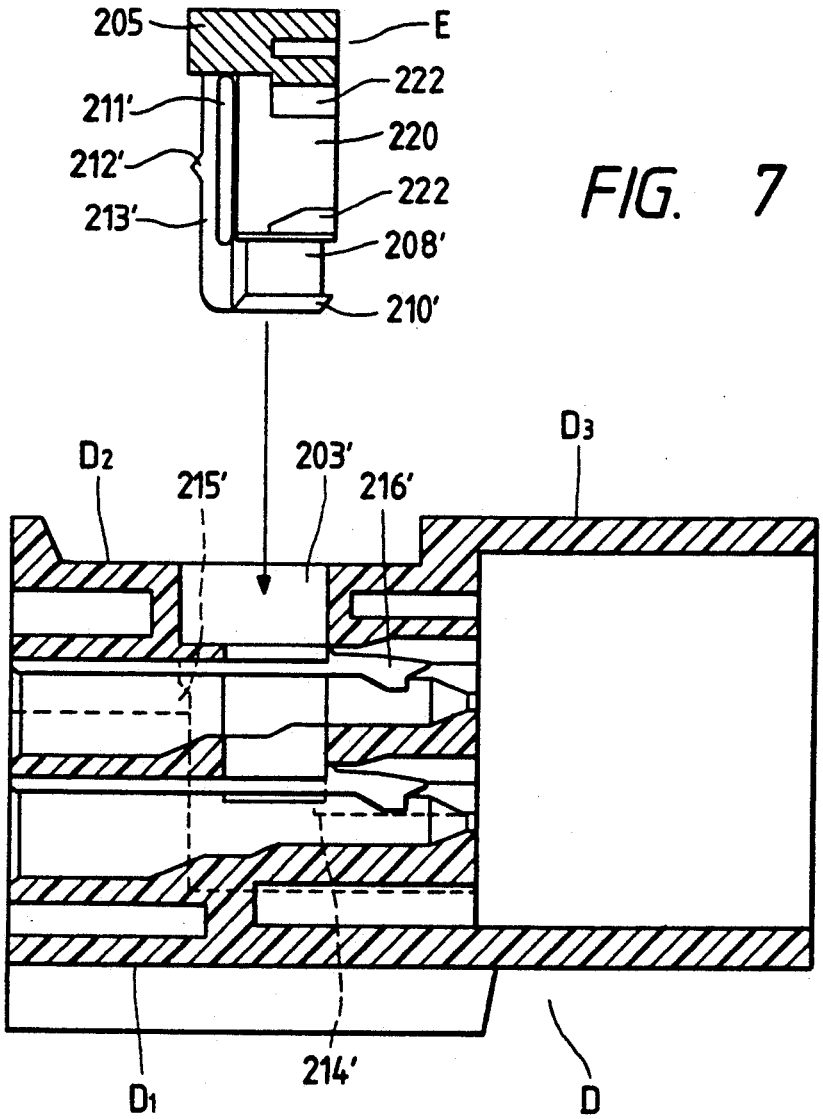
FIG. 7 is an sectional view of separate condition between a connector housing and terminal lock member shown in FIG. 5.

In the connecter housing D, as shown in FIG. 7, a first engaging portion 214 and a second engaging portion 215 are provided in correspondence to the first lock protrusion 210 and the second lock protrusion 212 of the terminal lock member E, respectively.

When the terminal lock member is inserted in the connector housing through the cavity 203, the first engaging portion 214 is engaged with the first lock protrusion 210 to position the terminal lock member E in temporary engaging position. Namely, the first engaging portion 214 is disposed in such a manner that the terminal lock portion 222 is preferably stopped and maintain at an outer portion of the terminal accommodating chamber 201 to allow the insertion of the male terminal F. (temporary locking position).

The second engaging portion 215 is further inserted to move the terminal lock member E from the temporary engaging position to a real locking position the second engaging portion 215 is engaged with the second lock protrusion 212. The second engaging portion 215 is disposed in such a manner that the terminal lock portion 222 is engaged with the engaging protrusion 223 to prevent terminals form coming off backwardly (real locking position).

Figure 8A:
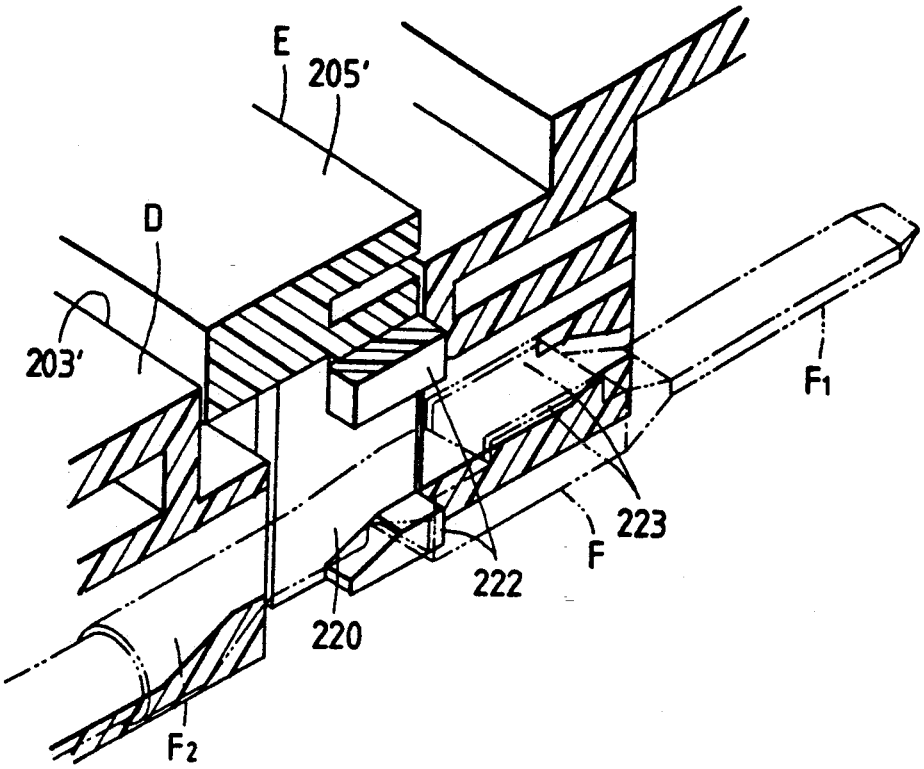
FIG. 8 (*a*) and (*b*) are perspective views of relationship between the terminal lock member E in temporarily locked and positively locked, respectively.
Figure 8B:
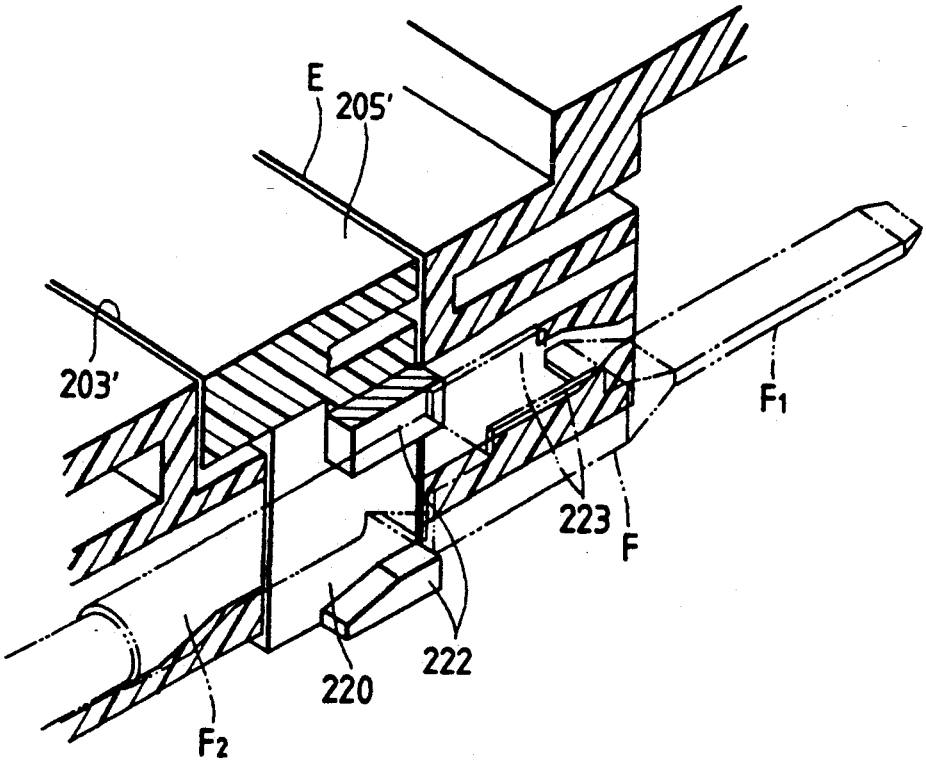
Figure 9A:
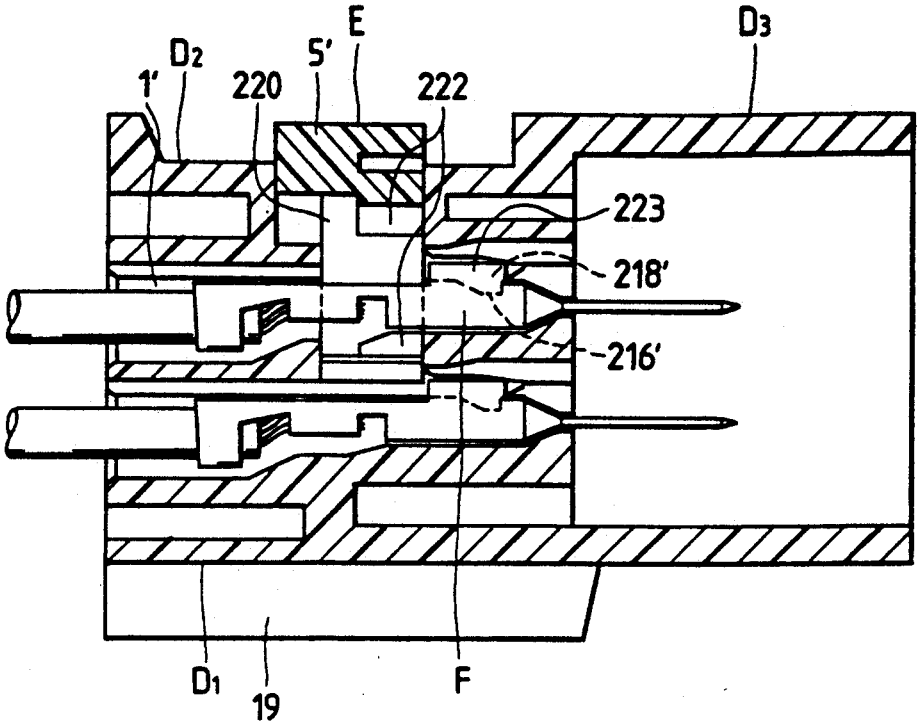
FIG. 9 (*a*) and (*b*) are sectional views of relationship between the terminal lock member E in temporary locked and positively locked, respectively.
Figure 9B:
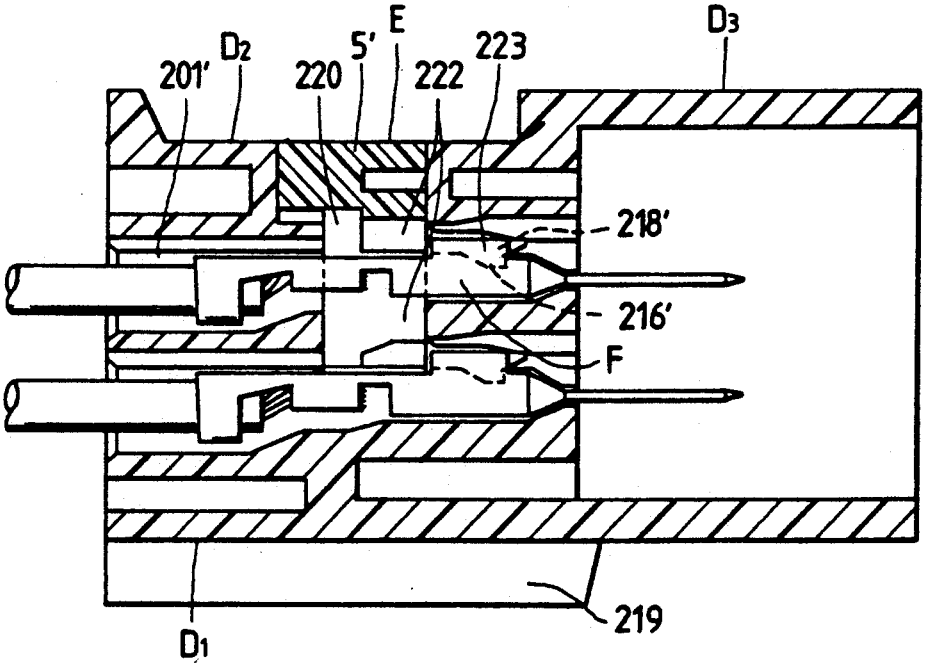
Figure 10:
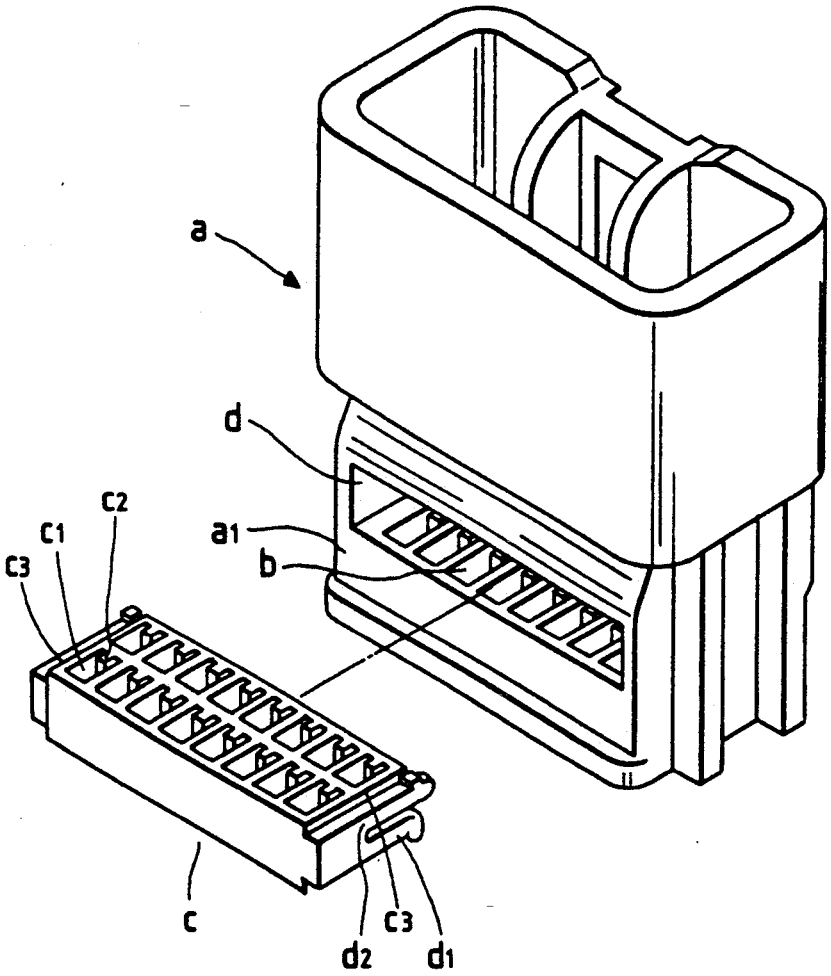
FIG. 10 PRIOR ART
FIG. 10 is a perspective view of a conventional connector.

FIGS. 8 (A), (B) and FIGS. 9 (A) and (B) show side and sectional views of the relationship between the terminal lock member and mail terminal in temporary and real locking positions, respectively.

The structure that the positional relationship between the terminal lock member E and the connecter housing D in temporary and real locking positions is the same as that of FIGS. 3 (*a*) and (*b*) so that the detailed description is omitted.

In the temporary locking position of terminal lock member E, the terminal lock portions 208 provided with the side plate 208 and the side walls 220 and 221 are separated from the terminal accommodating chamber 201 (in FIGS. 8 and 9, the terminal lock member E is positioned above the terminal accommodating chamber 101), so that the mail terminal F can be pulled out from the rear portion of the connector housing D.

In the temporary locking position, the mail terminal F is inserted into the terminal accommodating chamber 201 so that the flexible arm formed in the terminal accommodating chamber 101 is engaged with the engaging hole 218 of a electric connecting portion F to primarily lock the electric terminal.

In the condition described above, the terminal lock member E is positioned in the real locking position so that the terminal lock position 222 provided with both side walls 220 (side wall 221, side plate 208) are positioned at the backside of the lock protrusion 223 of the electric contact portion $F_1$ to engage the terminal F with terminal lock portion 222 so that the terminal is double locked.

By inverting the order of the above-described connector assembling steps, the terminal lock member E can be unlocked from the connector housing. The terminal lock member E is o equally applied to the male connector housing with the female terminals.

The arrangement of the first and second stop protrusions is not limited to this embodiment. The first and second stop protrusions may be disposed on side walls 220 and/or 221.

As was described above, in the connector of the invention, the locking members are formed on the front and rear end faces of the vertical plates forming the terminal block member which is inserted into the connector housing through the cavity formed in one outer wall of the latter, to temporarily lock the terminal lock member and then to positively lock it. Therefore, the locking members are never deformed by external force, thus being able to lock the terminal lock member with high stability. Furthermore, the connector can be miniaturized with the terminal lock member prevented from increasing in width.

What is claimed is:

1. A connector comprising:

a housing having a plurality of terminal accommodating chambers arranged therein, and a cavity formed in one outer wall thereof in such a manner that said cavity is extended vertically across partition walls of said terminal accommodating chambers;

a terminal lock member including a plurality of vertical plates which combine to define a plurality of openings in correspondence to said plurality of terminal accommodating chambers and terminal lock portions in said openings which are engageable with terminals, a pair of said vertical plates being side plates respectively disposed at opposite ends of said terminal lock member; and terminal lock means for locking said housing and said terminal lock member by inserting said terminal lock member into said housing through said cavity to position said terminal lock member from a temporary locking position to a real locking position, wherein said terminal lock means includes:

at least one of said side plates;

a first terminal lock protrusion formed on one end face of said one side plate of said terminal lock member;

a flexible arm formed on the other end face of said one side plate of said terminal lock member with a slit being formed between said first terminal lock protrusion and said flexible arm, said flexible arm having a second terminal lock protrusion protruded from said flexible arm; and wherein said housing includes:

a first engaging portion, formed on said housing, engageable with said first terminal lock protrusions when said terminal lock member is inserted into said housing to said temporary locking position where said openings thereof are substantially aligned with said terminal accommodating chambers; and a second engaging portion, formed on said housing, engageable with said second terminal lock protrusion when said terminal lock member is moved from said temporary locking position to said real locking position where said terminal locking portions engage with said terminals to prevent said terminals from moving in backwardly.

2. A connector as claimed in claim 1 wherein said one side plate is disposed on an inner side of a cover plate of said terminal lock member.

3. A connector as claimed in claim 2, wherein said terminal lock portions protrudes from an inner side of said cover plate.

4. A connector as claimed in claim 1, wherein said terminal lock portion protrudes from said one side plate.

5. A connector as claimed in claim 1, wherein said terminal lock member is a grid shaped frame.

6. A connector as claimed in claim 1, wherein said terminal lock member is a comb shaped frame.

* * * * *